US005622517A

United States Patent [19]

Heng et al.

[11] Patent Number: 5,622,517

[45] Date of Patent: Apr. 22, 1997

[54] ELECTRICAL CONNECTION MODULE CONTAINING A CONNECTOR PART OF THE TYPE HAVING A WIRE-RETAINING SLOT PROVIDED WITH AN INSULATION-DISPLACEMENT INLET

[75] Inventors: Jean-Paul Heng, Lyons; Ariel Ruiz, Villeurbanne; Luc Doutaz, Lyons, all of France

[73] Assignee: Entrelec S.A., Villeurbanne, France

[21] Appl. No.: 497,944

[22] Filed: Jul. 3, 1995

[30] Foreign Application Priority Data

Jul. 4, 1994 [FR] France ..... 94 08210

[51] Int. Cl.[6] ..... H01R 4/24

[52] U.S. Cl. ..... 439/417; 439/835

[58] Field of Search ..... 439/396, 402, 439/417, 418, 835

[56] References Cited

U.S. PATENT DOCUMENTS

| | | | |
|---|---|---|---|
| 4,435,034 | 3/1984 | Aujla et al. | 439/404 |
| 4,613,197 | 9/1986 | Munroe et al. | 439/418 |
| 5,240,432 | 8/1993 | Daoud | 439/417 |
| 5,415,562 | 5/1995 | Matsumoto et al. | 439/417 |

FOREIGN PATENT DOCUMENTS

| | | |
|---|---|---|
| 0270480A3 | 9/1989 | European Pat. Off. . |
| 2014819 | 10/1971 | Germany . |
| 2747395B1 | 4/1979 | Germany . |
| 2005487 | 4/1979 | United Kingdom . |
| 2084813 | 4/1982 | United Kingdom . |

*Primary Examiner*—David L. Pirlot
*Assistant Examiner*—Tho Dac Ta
*Attorney, Agent, or Firm*—Sughrue, Mion, Zinn, Macpeak & Seas

[57] ABSTRACT

A connection module including an insulating housing inside which a conductive connector part is held stationary, which connector part has a slot for receiving an electrical wire, into which housing an auxiliary part penetrates that is provided with a wire-pusher element mounted to slide in the housing along the slot and along a wire-receiving opening in the housing. The auxiliary part is provided with an operating element which projects from the housing, and which is held in the pushed-in position by co-operation between a holding mechanism that it carries and complemetary holding mechanism in the housing. Structure provided on the operating element make it possible to act from the outside on the holding mechanism, thereby releasing the auxiliary part when it is held stationary so as to enable it to slide.

9 Claims, 2 Drawing Sheets

C1
C1'
C1''
C2
C2'
IV
III

ELECTRICAL CONNECTION MODULE CONTAINING A CONNECTOR PART OF THE TYPE HAVING A WIRE-RETAINING SLOT PROVIDED WITH AN INSULATION-DISPLACEMENT INLET

The invention relates to an electrical connection module containing a contact part of the type having a wire-retaining slot provided with an insulation-displacement inlet.

BACKGROUND OF THE INVENTION

A known technique for connecting an electrical wire to an electrically conductive contact part consists in providing a slot for retaining the core of a wire, which slot is open along one edge of the part so as to enable the wire to be pushed transversely into the slot in which the core of the wire is nipped after its covering has been locally displaced by the edges of the inlet via which the slot opens out in the edge of the part.

An electrical connection facility implementing that technique is described in particular in Document FR-A-2 611 406. That facility, which is more particularly intended for use in a terminal block, is received in a housing made of an insulating material inside which a conductive connector part is held stationary that has a slot for retaining the core of a wire. The housing is provided with an opening having a first portion enabling a wire to be inserted into the housing to a penetration position from which the wire can be caused to penetrate into an insulation-displacement inlet of the slot transversely thereto. The opening is extended by a second portion which extends along the slot and which is organized to retain the covering of a suitable wire whose core is retained in the slot after it has been caused to penetrate therein.

An auxiliary operating part is provided for displacing the covering on the core of the wire and for pushing the core and the wire respectively into the slot and into the second opening portion until they reach a position in which the core of the wire and the covering thereof are retained respectively by the slot and by the opening. For that purpose, the operating part slides along the slot and along the second opening portion, thereby enabling a wire to be pushed therein from a first position in which the wire can be suitably placed facing the insulation-displacement inlet of the slot prior to being caused to penetrate therein, to a second position in which the wire is held by its core and its covering being nipped.

The auxiliary part can be operated from outside the housing by means of an opening which enables it to be pushed in under pressure from the shank of a tool, such as a screwdriver. The auxiliary part must return resiliently to the penetration position after it has been pushed in to connect a wire by penetration.

Insofar as connecting a wire by penetration involves applying high pressure to the auxiliary part, the connection method used means that the facility must be at least placed and preferably fixed on a support that is capable of withstanding the connection pressure. Such a facility is therefore quite suitable when it is used in a terminal block fixed to a rigid support. Unfortunately, it is more difficult to implement when it is incorporated in a connection module, e.g. that is to be received in a container inside which it is not fixed, e.g. for reasons of cheapness. It is then important to be able to connect wires and optionally to disconnect them with the most commonly used tools, e.g. screwdrivers and/or rib-joint pliers, without a fixed abutment surface being necessary.

OBJECT AND SUMMARY OF THE INVENTION

To this end, the invention provides a connection module including an insulating housing inside which a conductive connector part is held stationary, which connector part has an insulation-displacement and wire-retaining slot provided with inlet for at least one electrical wire conductive core. The housing has a wire-insertion opening provided with a first portion via which a wire to be connected can be inserted to a penetration position relative to the insulation-displacement inlet of the slot, prior to pushing the core of the wire transversely into the slot, and a second portion for retaining, by nipping, the covering of any suitable wire whose core is retained by being nipped in the slot into which it has been pushed. The module further including an auxiliary part provided with a wire-pusher element mounted to slide in the housing along the slot and/or the opening between a first position in which it is possible to insert a wire between the pusher element and the insulation-displacement inlet of the slot, and a second position in which the core of a wire pushed into the slot and the corresponding covering of the wire pushed into the opening are retained therein by being nipped. According to a characteristic of the invention, the module includes an auxiliary part that is provided with an operating element which projects from the housing, which is held in at least the second position by co-operation between holding means carried by it and complementary holding means in the housing, and which includes external operating means disposed on the operating element so as to act on at least some of the holding means, thereby releasing said auxiliary part when it is held in the second position so as to enable it to be returned to the first position.

BRIEF DESCRIPTION OF THE DRAWINGS

The invention, its characteristics, and its advantages are described in more detail in the following description given with reference to the accompanying drawings, in which.

MORE DETAILED DESCRIPTION

Figure 1:
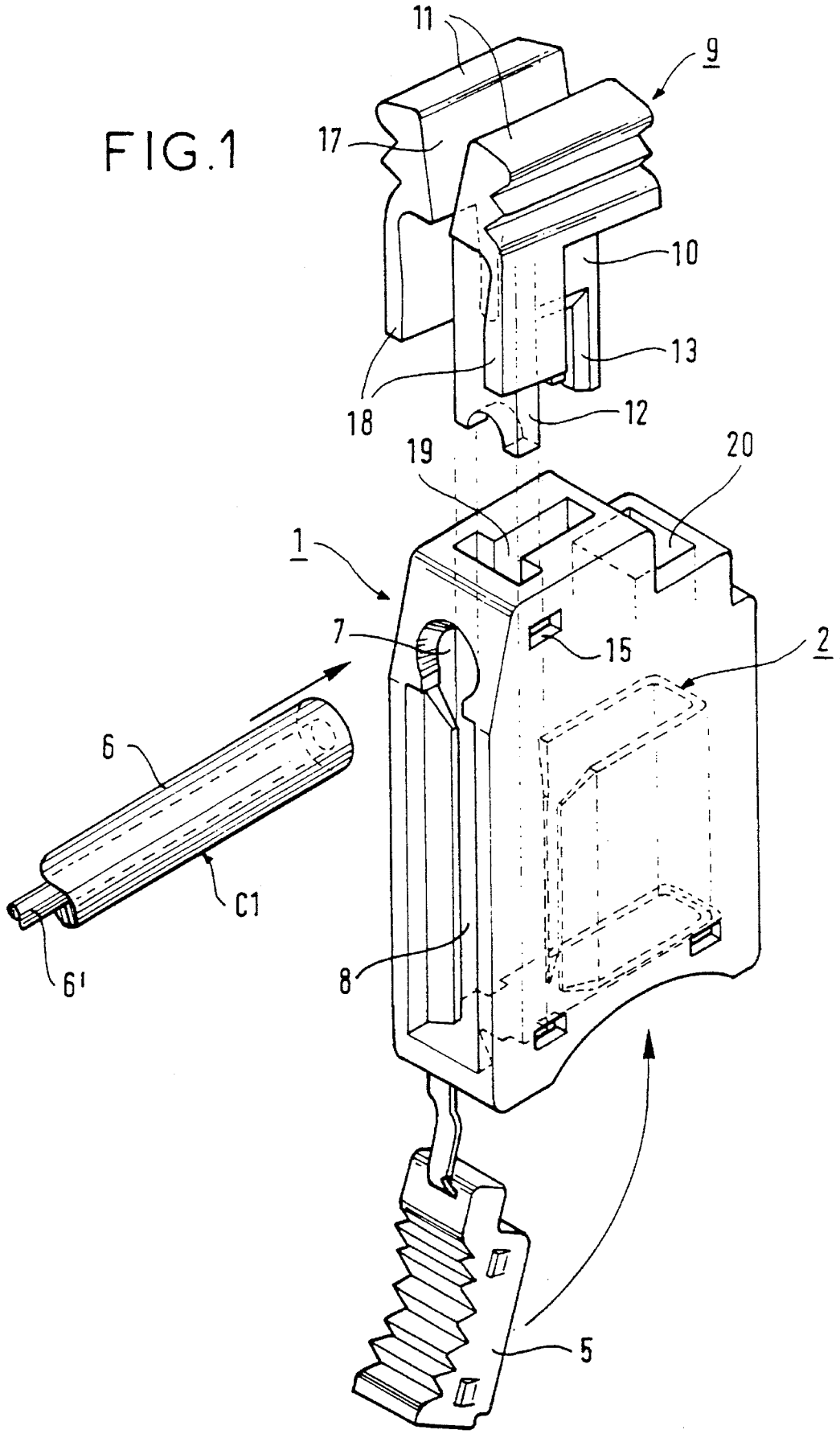
FIG. 1 is an exploded perspective view of an embodiment of a connection module of the invention, associated with a portion of wire to be connected.

FIG. 1 shows an electrical connection module of the type having a contact provided with an insulation-displacement and wire-retaining slot. The module includes an insulating housing 1 in which at least one conductive connector part 2 is held stationary. The connector part is provided with a wire-retaining slot having an insulation-displacement inlet. It is shown in dashed lines inside the housing in FIG. 1, and in more detail in FIGS. 2 to 5.

Figures 2, 3, 4, 5:
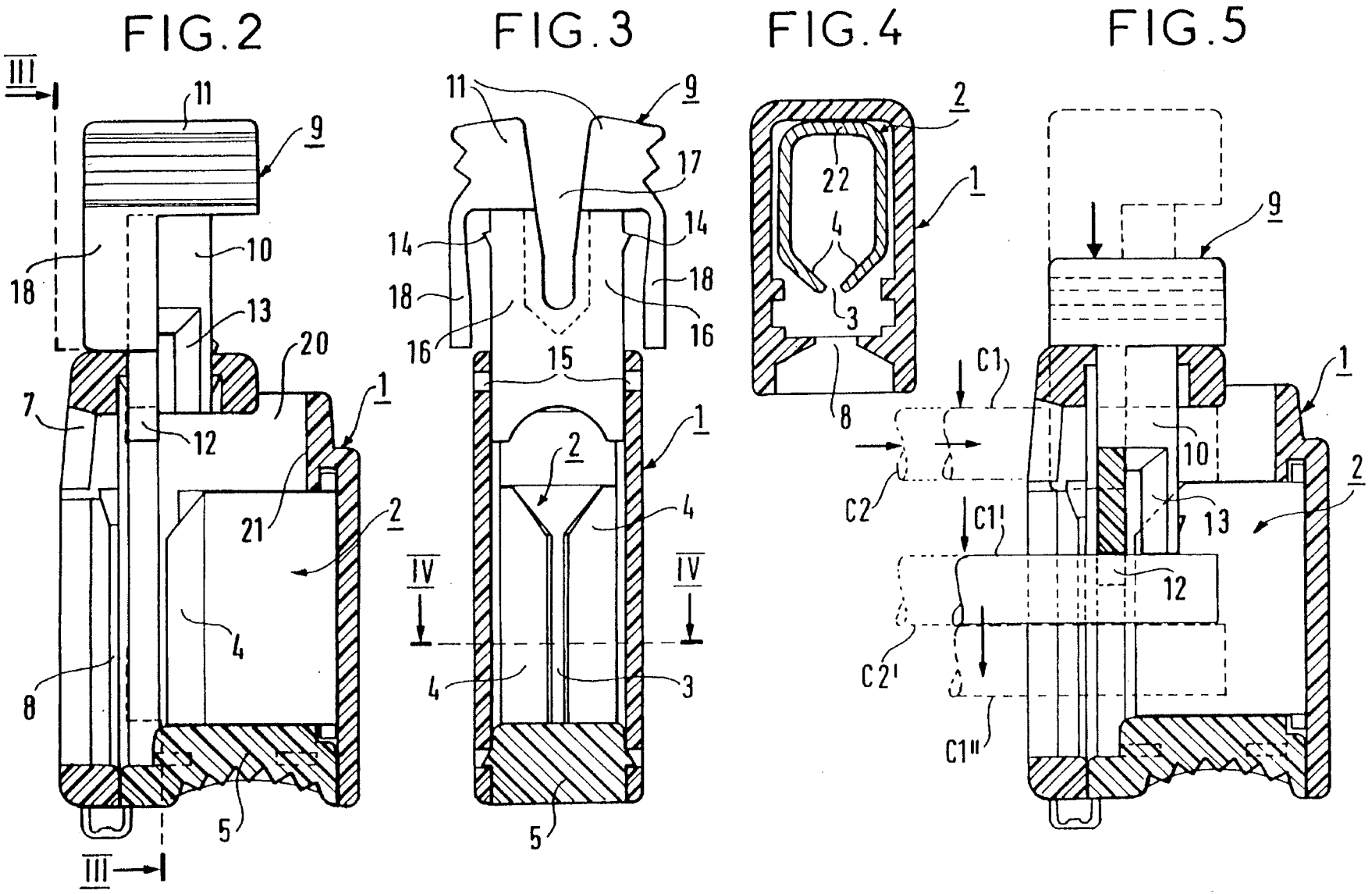
FIG. 2 is a cross-sectional view on a midplane of the connection module shown in FIG. 1, with an auxiliary operating part being shown in a first position.
FIGS. 3 and 4 are section views respectively on III—III and on IV—IV of the connection module-shown in FIG. 1.
FIG. 5 is a cross-sectional view on a midplane of the connection module shown in FIG. 1, with an auxiliary operating part being shown in a second position.

For example, the connector part 2 may be implemented in a manner corresponding to that described, in particular, in above-mentioned Document FR-A-2 611 406. The connector part is provided with a wire-core retaining slot 3 having an insulation-displacement inlet for electrical wires that are suitable, i.e. that have physical characteristics and in particular dimensional characteristics lying in a given range, which is generally quite limited, for any given model of the part, as is known. The connector part 2 in this example is provided with an insulation-displacement slot 3 that is essentially rectilinear, and that is disposed along a shaped-section portion obtained by cutting and folding a metal strip. In this example, the shaped-section portion of the connector part 2 has a hollow cross-section that is approximately in the shape of a channel section whose ends have been folded in towards each other at equal oblique angles so as to form two lips 4 that flank the slot 3, as shown in FIG. 4. The slot is provided with an insulation-displacement inlet assigned to cutting through the covering (such as the covering 6 on cable C1 shown in FIG. 1) on the wires pushed into the slot via said inlet. For example, the inlet is obtained by chamfering the portions forming the lips 4, and it is assumed to be disposed at the top of the part as shown in FIGS. 1 to 3 and in FIG. 5.

In known manner, the housing 1, which in the example shown is provided with a single connector part, may be designed to receive a plurality of such parts, e.g. in pairs, the connector parts being optionally interconnected where necessary. Advantageous dispositions may in particular be achieved by disposing two connector parts such that their respective retaining slots are situated on either side of the assembly formed by the two parts, or else by disposing two connector parts side-by-side, with their retaining slots on the same side of the assembly that is formed by them. The inlets of the slots may be disposed at opposite ends from each other by mounting the two parts head-to-tail, or they may be disposed along side each other by mounting the two parts side-by-side. In the same way, two preferably identical housings may be associated together mechanically and/or electrically, using a wide variety of dispositions both for the housings and for the connector parts received therein. For reasons of simplicity, a housing that is assumed to contain a single part is described in more detail herein, it being understood that it is not difficult for a person skilled in the art to deduce a certain number of variants therefrom.

In the example given, and in known manner, the housing 1 may be made by using various methods, and in particular by assembling together and optionally welding elements which are, for example, made by molding an insulating material, the elements forming and/or being provided with cavities and shapes for receiving and/or holding stationary one or more connector parts.

In the embodiment given by way of non-limiting example, the housing is assumed to be closed at its bottom by a bottom-forming element 5 that is molded with the remainder of the housing (which otherwise forms a single block) and, for example, that is swung closed and secured thereto after the connector part 2 has been inserted and put into position.

In known manner, and in the example given, the housing is provided with an opening extending facing the retaining slot 3 in the connector part 2, as shown in FIG. 1. The opening includes a first portion 7 via which a suitable wire to be connected can be inserted into the housing so that it is in the penetration position relative to the insulation-displacement inlet of the retaining slot 3, like either of wires C1 and C2 shown in dashed lines in FIG. 5.

In known manner, the opening is extended beyond portion 7 (which is circular in appearance in the example) by a second portion 8 (which has parallel edges in this example) extending along the slot 3 so as to enable a wire (such as C1) to be retained by its covering (such as 6) once the core 6' of the wire has been pushed into the slot 3 beyond the insulation-displacement inlet of the slot.

The connection module also includes an auxiliary part 9 which includes a wire-pusher element 10 that is mounted to slide in the housing along the slot and/or the opening between two positions. When the wire-pusher element is in a first one of the two positions (the first position being shown in FIGS. 2 and 3), it is possible to insert a wire into the housing 1 between the slidably mounted pusher element 10, and the insulation-displacement inlet of the slot 3 before the insulation on the wire is displaced by said inlet, and before the wire is caused to penetrate into the slot transversely thereto, as shown for each of wires C1 and C2 in FIG. 5.

Pushing in the pusher element 10 by sliding it causes the core of the wire that has been inserted between the pusher element and the insulation-displacement inlet in said slot to be driven into said slot, thereby also driving the covering of the wire into the second portion 8 of the opening in the housing, until the pusher element reaches a second position which corresponds to the penetration limit to which the pusher element can be pushed in. By suitably choosing the characteristics, in particular the dimensional characteristics, firstly of the slot 3 and of the second opening portion 8, and secondly of the core and of the covering of the wire to be connected, it is possible to retain the wire respectively via its core relative to the connector part, where the core is electrically connected by contact, and via its covering relative to the housing. However, this involves subjecting the pusher element 10 to a high pressure tending to push it into the housing, thereby causing the insulation-displacement inlet to cut through the covering of the wire to be connected, and subsequently causing the covering to be pushed into the second opening portion 8 against the two edges of which it rubs, and, simultaneously, the core of the wire to be pushed into the slot against the edges of which the core also rubs.

In accordance with the invention, the pusher element 10 of the auxiliary part 9 is extended by an operating element 11 which is organized so that it projects relative to the housing regardless of the position taken up by the pusher element while it is sliding in the housing, so as to enable the pusher element to be displaced from outside the housing regardless of the position that it has reached by sliding in either direction.

In known manner, the pusher element 10 is shaped at its end so that the wire to be connected is properly positioned, against which wire the pusher element presses by being slid so as to drive the wire. In the example given, the pusher element includes two portions 12 and 13 enabling the wire to be pushed along and on either side of the slot, portion 12 penetrating between the slot and the housing facing the opening. The pushing end of element 10 and therefore in this example of each portion 12, 13 is shaped so that the wire to be connected can be guided and centered relative both to the inlet of the slot, and to the second opening portion into which the wire penetrates as it is pushed in. For example, the shaped end is at least approximately hollow semi-cylindrical in shape, as shown in FIG. 3.

Insofar as the force required to connect a wire is large, provision is made to enable pressure to be exerted on the projecting end of the operating element 11 of an auxiliary part by means of a clamping tool having moving jaws that are displaced more or less parallel to each other, e.g. by means of "rib-joint" pliers. The auxiliary part 9 then slides in the housing because of the clamping forces created by pressing one of the two jaws of the clamping tool against that end of the operating element 11 which projects from the housing 1, and the other jaw against the bottom of the housing at the opposite end from element 11. In the embodiment given, the bottom of the housing and the projecting end of the operating element are shaped so as to facilitate their engagement with the jaws of the tool, by means of dispositions known to a person skilled in the art, e.g. by providing serrations in the bottom, as shown in particular in FIGS. 1 and 2.

For various reasons, and in particular for reasons of compactness, it is preferable for the auxiliary part to be held pushed in, in its second position, once the wires have been connected to the connection module. Means are therefore provided for holding the auxiliary part 9 in position once the pusher element 10 of said auxiliary part has been slid to its second position which constitutes the penetration limit to which it can penetrate into the housing. The second position is set, in known manner, such that any suitable wire whose core has been pushed into the slot 3 and whose covering has been simultaneously pushed into the second opening portion 8 by the pusher element 10 is retained by said slot and by said second opening portion.

In a preferred embodiment of the invention, the means for holding the auxiliary part 9 in position are carried by the auxiliary part, e.g. by the pusher element 10, and they co-operate with complementary holding means provided in the housing. For example, such means for holding the auxiliary part may be constituted by lugs 14 disposed on either side of portion 12 of the pusher element 10 in a zone of the element that is situated inside the housing 1 once the housing has been slid into its second position in which it penetrates to the maximum possible extent into the housing. They retract, e.g. resiliently, while the auxiliary part is being pushed in, and they then engage in recesses 15, e.g. holes, which are provided for them in the housing, thereby preventing the auxiliary part 9 and in particular its pusher element 10 from sliding out, so long as the co-operation between the complementary holding means 14 and 15 is not intentionally interrupted. In this way, it is possible for the pusher element 10 to contribute to retaining the wire(s) pushed by it into the slot 3 and into the opening portion 8.

Optionally, the auxiliary part 9 may also be provided with similar holding means enabling it to be held in the first position from which the wire to be connected can be caused to penetrate.

In a preferred embodiment, it is possible for the lugs 14 which constitute the holding means provided on the auxiliary part 9 to be displaced from outside the connection module so that they can be disengaged from the complementary holding means provided in the housing, thereby enabling the pusher element 10 to be slid out therefrom. For this purpose, the auxiliary part includes operating means which are preferably constituted by portions (two portions in this example) 16 of the operating element 11. These portions 16 carry the respective lugs 14 and are organized so as to be elastically deformable under drive from forces exerted on the outside of the operating element, and so as to enable the lugs 14 to be disengaged from the recesses 15 when the lugs are engaged therein.

In a preferred embodiment, the two portions 16 of an auxiliary part are constituted by subdividing part of the operating element 11 that includes them. Such subdivision creates a middle gap 17 which is open at that end of the operating element which projects from the housing, and which makes it possible to bring the two portions together by clamping together their respective projecting ends, because of their relative resilience.

Bringing them together by clamping them in this way is calculated so as to cause the lugs 14 to be disengaged from the recesses 15 when they are engaged therein. Portions 16 are organized and the shape and positions of the lugs are chosen in such manner that the lugs normally engage, in known manner, so as to prevent the auxiliary part from sliding out from the housing once said part has reached its second position, so long as lug-disengaging clamping has not been performed on portions 16 of the operating element. In the embodiment shown in FIGS. 1 to 5, an outer extension 18 is provided on each of the two portions 16 of the operating element 11. Each extension slides against the outside surface of the housing, along which surface the portion 16 provided with the extension slides while the auxiliary part 9 is being displaced, thereby providing additional guide means for guiding the operating element. FIG. 3 shows that the lugs 14 are provided on portions 16 in the zones that are situated respectively between each portion 16 and the extension 18 thereof.

In one embodiment, each extension 18 is resiliently urged towards the portion 16 that carries it, thereby enabling the auxiliary part to be held in its first position in which it enables a wire to be inserted into the housing, the end of each extension then coming into abutment against the housing in the vicinity of an orifice 19 in the housing (see FIG. 1) via which the auxiliary part passes. By clamping the operating element at the respective projecting ends of portions 16, the extensions are moved away from the respective portions 16, thereby enabling them to pass along the outside of the housing. In a variant embodiment (not shown), the holding means which enable the pusher element 10 to be retained pushed into the housing in the second position are provided on the insides of the respective ends of the extensions 18 in those zones of the extensions which slide on the outside of the housing. The outside of the housing is then provided with complementary recesses, e.g. in the form of holes which are complementary to the means carried by the extensions 18. The recesses are disposed so as to retain the auxiliary part with its pusher element pushed into the housing in the second position, and they enable the engaged complementary holding means to be disengaged when the operating element is clamped in a manner analogous to that indicated above.

A wire is connected in a connection module such as the module described above by inserting a non-stripped end of a wire, such as C1, into the housing via the first opening portion 7 until the wire abuts against the end of the housing 1. In the embodiment given, the housing includes an aperture 20, optionally capable of being shut off, making it possible to check that the wire has been inserted far enough into the housing relative to the insulation-displacement inlet of the slot 3, the wire also coming into abutment against a wall 21 of the housing that overlies the end wall 22 of the connector part 2. After the wire has been inserted, the auxiliary part is pushed into the housing by means of a clamping tool, e.g. such as a pair of rib-joint pliers as indicated above, optionally after the auxiliary part has been released so that it can be pushed in. Such release may be obtained by clamping, in the above-mentioned variant; it may optionally be obtained by applying high enough penetration pressure, if the auxiliary part includes means for holding it the first position that are, for example, of the retractable protuberance type which can be retracted under high sideways pressure, as is common in this field. For example one or more of such protuberances may be provided on the auxiliary part so that they lie almost flush with the orifice 19 on the outside of the housing when the pusher element is in its first position.

By pushing in the pusher element until it reaches it second position the wire is both connected and retained.

If it is necessary to connect another wire, the auxiliary part can be disengaged by being clamped, as indicated above, and it can be slid manually back until its pusher element has returned to its first position, whereupon it is possible to insert a second wire, such as C2, into the housing via the first opening portion 7. The operation described above is then performed again with wire C2, the pusher element pushing wire C2 against wire C1 when the pusher element reaches the end of its penetration stroke. Wire C2 has then reached the position referenced C'2 in FIG. 5, which position corresponds to the position referenced C'1 formerly occupied by wire C1. Wire C1 is then pushed into a position referenced C"1 by the other wire. By clamping together portions 16 of the operating element, it is also possible to return the auxiliary part to its first position so as to extract the connected wire(s), e.g. under pressure from the blade of a tool, e.g. a screwdriver blade inserted via the second opening portion 8 into the slot 3 against the wire that was pushed in first, so as to push it back up towards the insulation-displacement inlet of the slot, and so as to extract it via the first opening portion 7 of the housing.

We claim:

1. A connection module including an insulating housing inside which a conductive connector part is held stationary, which connector part has a wire-retaining slot provided within insulation-displacement inlet for at least one electrical wire conductive core, the housing having a wire-insertion opening provided with a first portion via which a wire to be connected can be inserted to a penetration position relative to the insulation-displacement inlet of the slot, prior to pushing the core of the wire transversely into the slot, and a second portion for retaining, by nipping, the covering of any suitable wire whose core is retained by being nipped in the slot into which it has been pushed, the module further including an auxiliary part provided with a wire-pusher element mounted to slide in the housing along the slot and/or the opening between a first position in which it is possible to insert a wire between the pusher element and the insulation-displacement inlet of the slot, and a second position in which the core of a wire pushed into the slot and the corresponding covering of the wire pushed into the opening are retained therein by being nipped, said module including an auxiliary part that is provided with an operating element which projects from the housing, which is held in at least the second position by co-operation between catch-type holding means carried by it and complementary holding means in the housing, and which includes external operating means disposed on the operating element so as to act on at least some of the holding means, thereby releasing said auxiliary part when it is held in the second position so as to enable it to be returned to the first position, wherein said operating means of said auxiliary part are formed by two portions of the operating element, which portions carry the catch-type holding means provided on the auxiliary part, and are separated by a gap and are elastically deformable by clamping from the outside so as to close said gap, so that they can be elastically deformed from a rest state in which the holding means on the auxiliary part co-operate with the complementary means in the housing so as to hold the auxiliary part in the second position, once said second position has been reached by the auxiliary part, to a deformed state in which the catch-type holding means is disengaged from the complementary holding means carried by the housing, thereby enabling the auxiliary part to be slid back to its first position.

2. A connection module according to claim 1, including an auxiliary part in which the gap provided between the deformable portions forming the operating means is open to the outside at the end of the operating element at that end of the auxiliary part which is opposite from its end that carries the wire-pusher element.

3. A connection module according to claim 1, wherein the holding means are provided in those zones of the operating element extensions which slide on the housing.

4. A connection module according to claim 1, wherein the holding means are constituted by lugs which co-operate with complementary recesses, one of these types of complementary holding means being provided in or on the operating element, and the other type being provided in or on the housing, in the vicinity of an orifice (19) via which the auxiliary part penetrates into the housing, so as to enable the part to be pushed into the housing from its first position and subsequently retained once it has reached its second position.

5. A connection module according to claim 1, including a housing in which at least two optionally electrically interconnected connector parts provided with slots are associated, each part being allocated its own pusher element, some of said pusher elements optionally being associated with a common operating element.

6. A connection module according to claim 1, including connector parts that are interconnected in pairs and that are received in the same housing which is therefore provided with as many wire-insertion openings as there are insulation-displacement and wire-retaining slots.

7. A connection module according to claim 1, including connector parts which are interconnected in pairs, and each of which or each pair of which is received in a different housing.

8. A connection module according to claim 1, including an auxiliary part whose holding means are provided in those zones of the operating element portions which slide in the housing.

9. A connection module according to claim 8, including an operating element whose deformable portions carry respective outer extensions which slide on the housing while the pusher element of the auxiliary part that includes them slides inside the housing, which are urged together resiliently so as to retain the auxiliary part in the first position after the part has been slid to said first position, and which release the part so as to enable it to slide when the operating element portions that carry them are brought together by being clamped.

* * * * *